US008405288B2

(12) United States Patent
Tsai

(10) Patent No.: US 8,405,288 B2
(45) Date of Patent: Mar. 26, 2013

(54) LED ILLUMINATION APPARATUS

(75) Inventor: Wen-Kuei Tsai, Taipei (TW)

(73) Assignee: Top Energy Saving System Corp., Taipei County (TW)

( * ) Notice: Subject to any disclaimer, the term of this patent is extended or adjusted under 35 U.S.C. 154(b) by 108 days.

(21) Appl. No.: 12/789,355

(22) Filed: May 27, 2010

(65) Prior Publication Data

US 2011/0248615 A1 Oct. 13, 2011

(30) Foreign Application Priority Data

Apr. 8, 2010 (TW) ..... 99206135 U

(51) Int. Cl.
*H01J 1/02* (2006.01)

(52) U.S. Cl. ..... 313/46; 313/498

(58) Field of Classification Search ..... 313/46, 313/498

See application file for complete search history.

(56) References Cited

U.S. PATENT DOCUMENTS

| | | | | |
|---|---|---|---|---|
| 4,574,879 | A * | 3/1986 | DeGree et al. | 165/185 |
| 5,070,936 | A | 12/1991 | Carroll et al. | |
| 5,491,619 | A * | 2/1996 | Gill | 362/294 |
| 2004/0195947 | A1 | 10/2004 | Clark et al. | |
| 2007/0236935 | A1 | 10/2007 | Wang | |
| 2009/0097249 | A1 | 4/2009 | Lee et al. | |
| 2010/0225220 | A1 * | 9/2010 | Tanaka et al. | 313/46 |

FOREIGN PATENT DOCUMENTS

| | | | |
|---|---|---|---|
| EP | 1928030 | A1 | 6/2008 |
| WO | 2009051128 | A1 | 4/2009 |
| WO | WO 2009/051128 | * | 4/2009 |

OTHER PUBLICATIONS

Extended European Search Report, EP 11157650, mailed Oct. 12, 2012.

* cited by examiner

*Primary Examiner* — Anh Mai
*Assistant Examiner* — Andrew Coughlin
(74) *Attorney, Agent, or Firm* — Stout, Uxa, Buyan & Mullins, LLP

(57) ABSTRACT

The present invention is directed to a light-emitting diode (LED) illumination apparatus. The apparatus includes a housing, an LED substrate, at least two electrical-insulation clamping members and associated screws, and a heat-conduction pad. At least one LED chip is fixed on the surface of the LED substrate. Each electrical-insulation clamping member has a threaded hole for screwing the screw in order to fasten the electrical-insulation clamping member to the housing; and each electrical-insulation clamping member has a recess for clamping the LED substrate. The heat-conduction pad is disposed between the housing and the LED substrate, and is used to conduct heat generated by the LED chip.

20 Claims, 13 Drawing Sheets

LED ILLUMINATION APPARATUS

CROSS-REFERENCE TO RELATED APPLICATIONS

The entire contents of Taiwan Patent Application No. 099206135, filed on Apr. 8, 2010, from which this application claims priority, are incorporated herein by reference.

BACKGROUND OF THE INVENTION

1. Field of the Invention

The present invention generally relates to an illumination apparatus, and more particularly to a light-emitting diode (LED) illumination apparatus.

2. Description of Related Art

Due to various advantages of a light-emitting diode (LED) such as small volume, short response time, low power consumption, high reliability and high feasibility of mass production, the LED is replacing conventional lighting device such as light bulb or fluorescent lamp.

FIG. 1 shows a partial cross sectional view of a conventional LED lamp. As shown in the figure, an LED aluminum substrate 102 with supported LED chips 100 is fixed on a housing 106 by screws 104. On the LED aluminum substrate 102, a predetermined spatial distance between circuit wiring neighboring the screw 104 and the screw 104 must be maintained to prevent improper electrical conduction and electric shock to users, and to pass product security test. However, there is oftentimes insufficient space on the LED aluminum substrate 102 to ensure the spatial distance, particularly to a small-size LED lamp or an LED lamp with many LED chips 100.

Accordingly, a need has arisen to propose a novel LED lamp to effectively prevent improper electrical conduction and pass product security test.

SUMMARY OF THE INVENTION

An object of the embodiment of the present invention is to provide an LED illumination apparatus to increase insulating impedance without sacrificing layout space on the LED substrate, thereby preventing improper electrical conduction and passing product security test.

According to one embodiment, an LED illumination apparatus includes a housing, an LED substrate, at least two electrical-insulation clamping members and associated screws, and a heat-conduction pad. At least one LED chip is fixed on the surface of the LED substrate. Each electrical-insulation clamping member has a threaded hole for screwing the screw in order to fasten the electrical-insulation clamping member to the housing; and each electrical-insulation clamping member has a recess for clamping the LED substrate. The heat-conduction pad is disposed between the housing and the LED substrate, and is used to conduct heat generated by the LED chip.

DETAILED DESCRIPTION OF THE INVENTION

Figure 1:
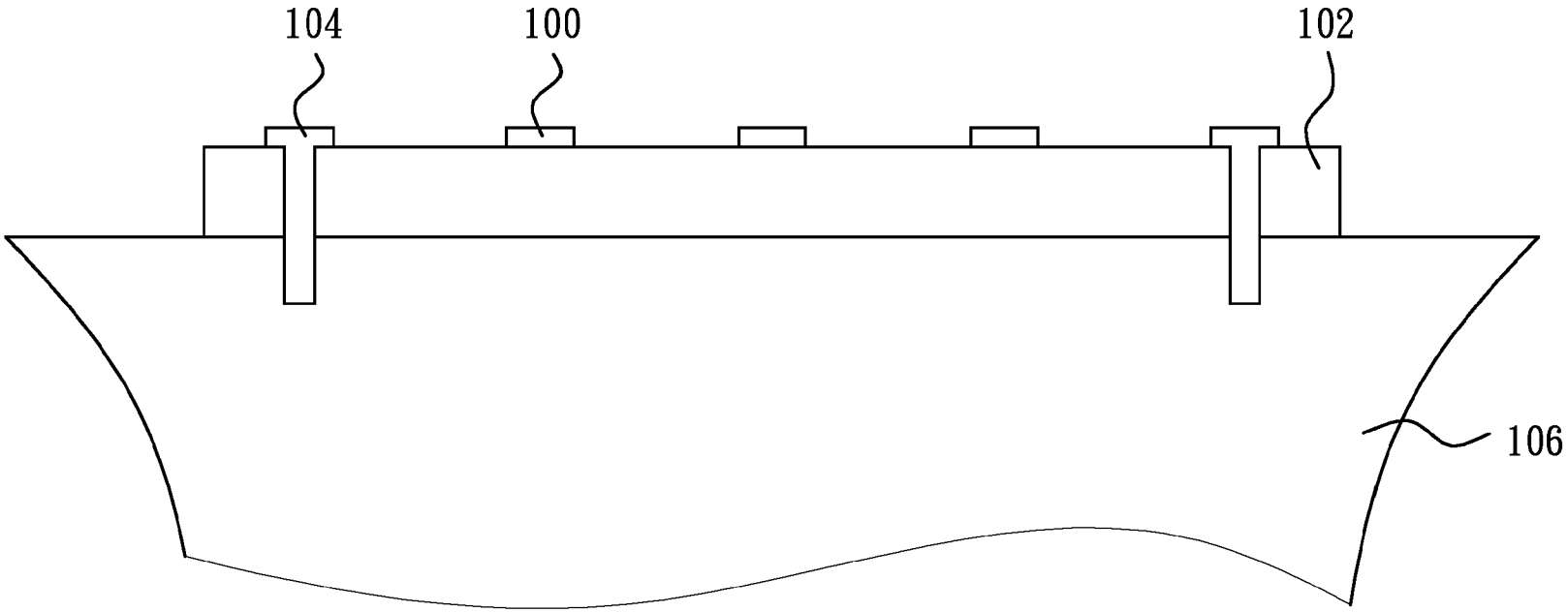
FIG. 1 (PRIOR ART)
FIG. 1 shows a partial cross sectional view of a conventional LED lamp.
Figure 2A:
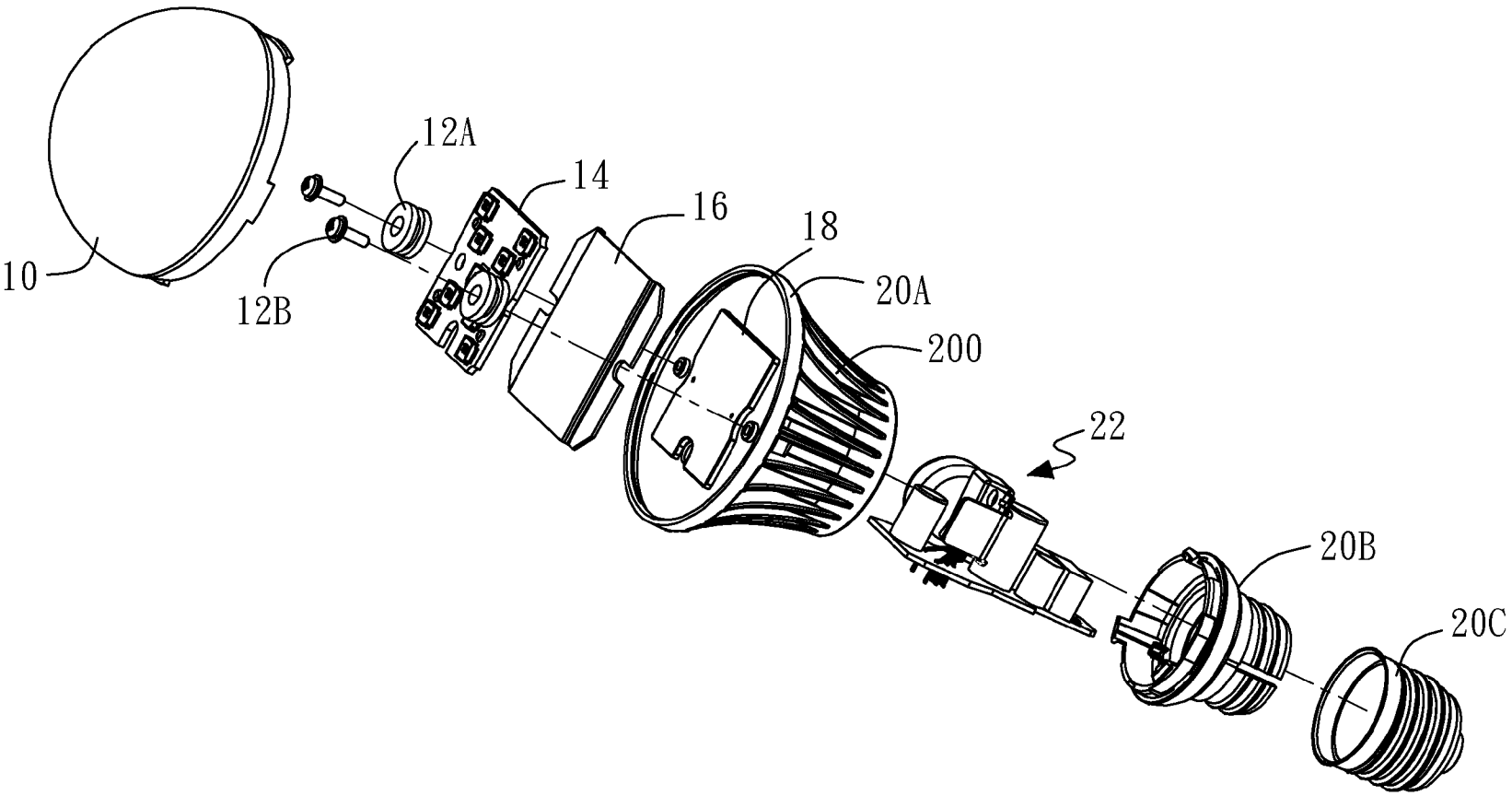
FIG. 2A shows an exploded view of an LED illumination apparatus according to a first embodiment of the present invention.
Figure 2B:
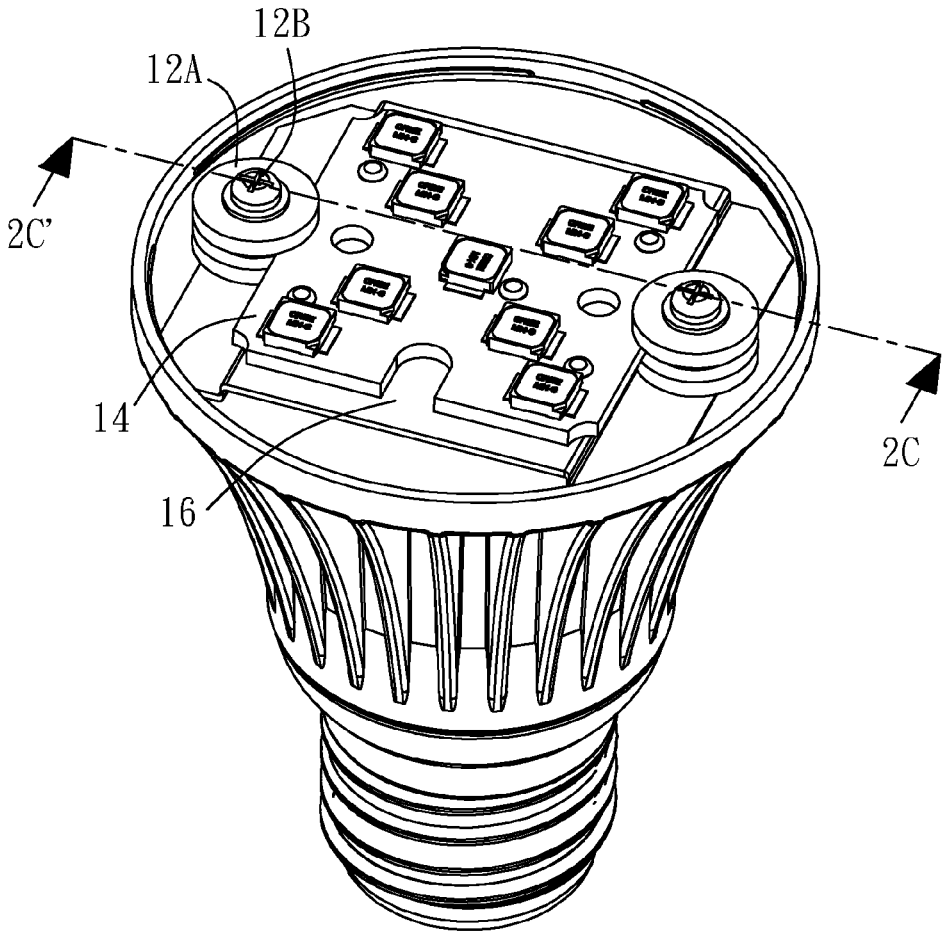
FIG. 2B shows a perspective view of an assembled LED illumination apparatus except for the lamp cover.
Figure 2C:
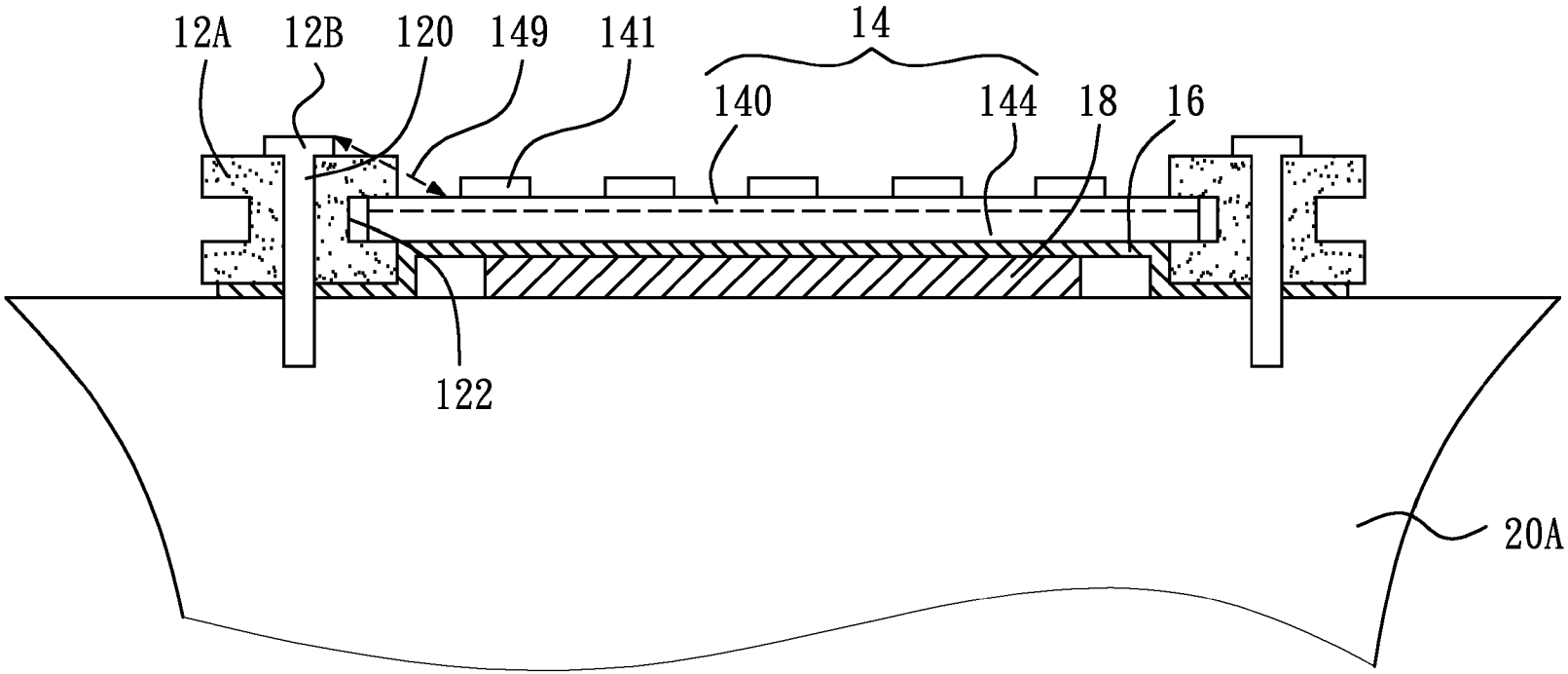
FIG. 2C shows a partial cross sectional view along a section line 2C-2C' of FIG. 2B.

FIG. 2A shows an exploded view of a light-emitting diode (LED) illumination apparatus according to a first embodiment of the present invention. FIG. 2B shows a perspective view of an assembled LED illumination apparatus except for the lamp cover. FIG. 2C shows a partial cross sectional view along a section line 2C-2C' of FIG. 2B. In the embodiment, the LED illumination apparatus has an appearance of, but not limited to, a conventional incandescent light bulb.

The LED illumination apparatus of the embodiment primarily includes a lamp cover 10, electrical-insulation clamping members 12A and associated screws 12B, an LED substrate 14, a heat-conduction insulation sheet 16, a heat-conduction pad 18, a housing (which includes a bottom housing 20A, a top housing 20B and an electrode contact part 20C in order) and a power supply 22. The power supply 22 is disposed in a space defined by the bottom housing 20A and the top housing 20B, and the lamp cover 10 covers the electrical-insulation clamping members 12A, the screws 12B, the LED substrate 14, the heat-conduction insulation sheet 16 and the heat-conduction pad 18.

Figure 2D:
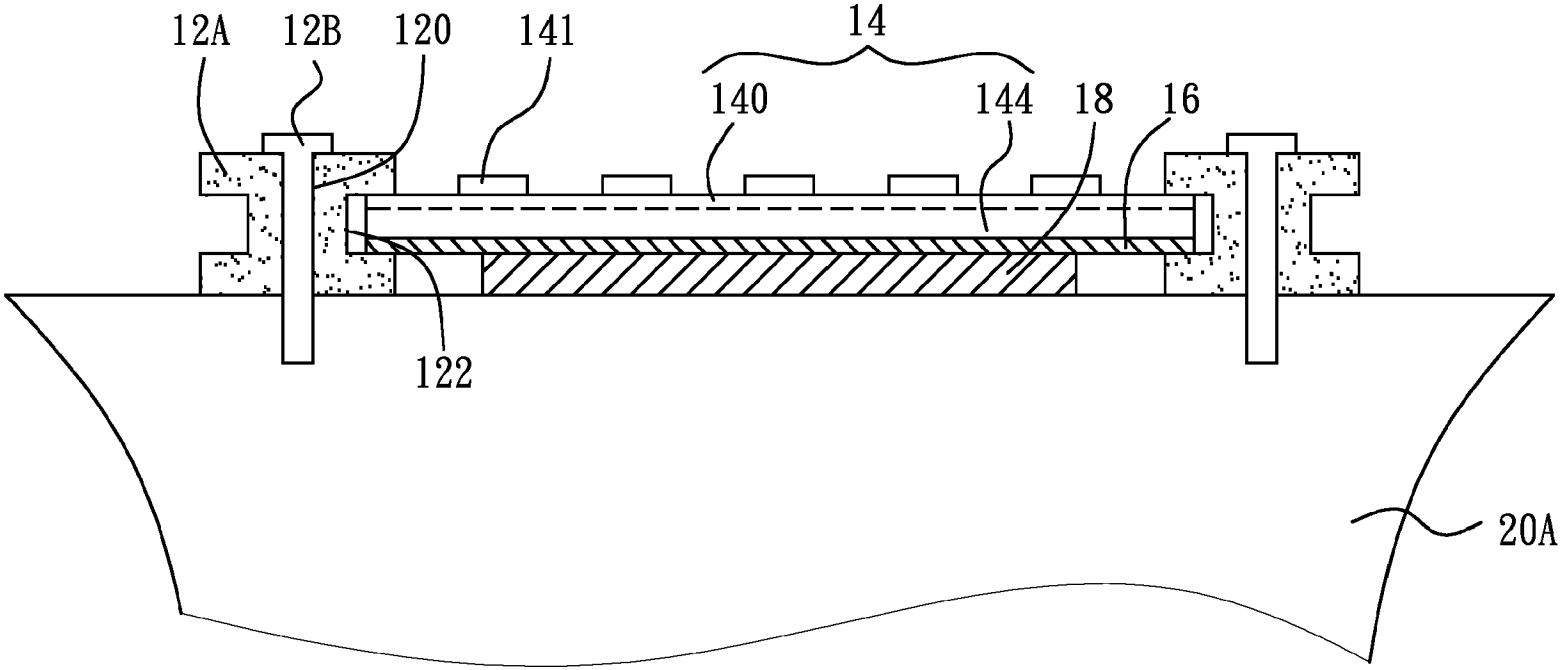
FIG. 2D shows a partial cross sectional view of a modified embodiment of the first embodiment.

The electrical-insulation clamping member 12A may be made of, but not limited to, plastic material. In the embodiment, the electrical-insulation clamping member 12A is, but not limited to, double-layer cylinders in shape, and is axially penetrated with a threaded hole 120 (FIG. 2C) for screwing the screw 12B. Generally speaking, the electrical-insulation clamping member 12A has a recess 122 having a direction perpendicular to the direction of the threaded hole 120 for clamping the LED substrate 14. In another embodiment, the electrical-insulation clamping member 12A clamps the heat-conduction insulation sheet 16 as well as the LED substrate 14 as shown in FIG. 2D. The electrical-insulation clamping member 12A in the embodiment consists of a single component, but may consist of multiple components in other embodiments. The embodiment adopts two electrical-insulation clamping members 12A, but may adopt more than two electrical-insulation clamping members 12A in other embodiments.

Figure 2E:
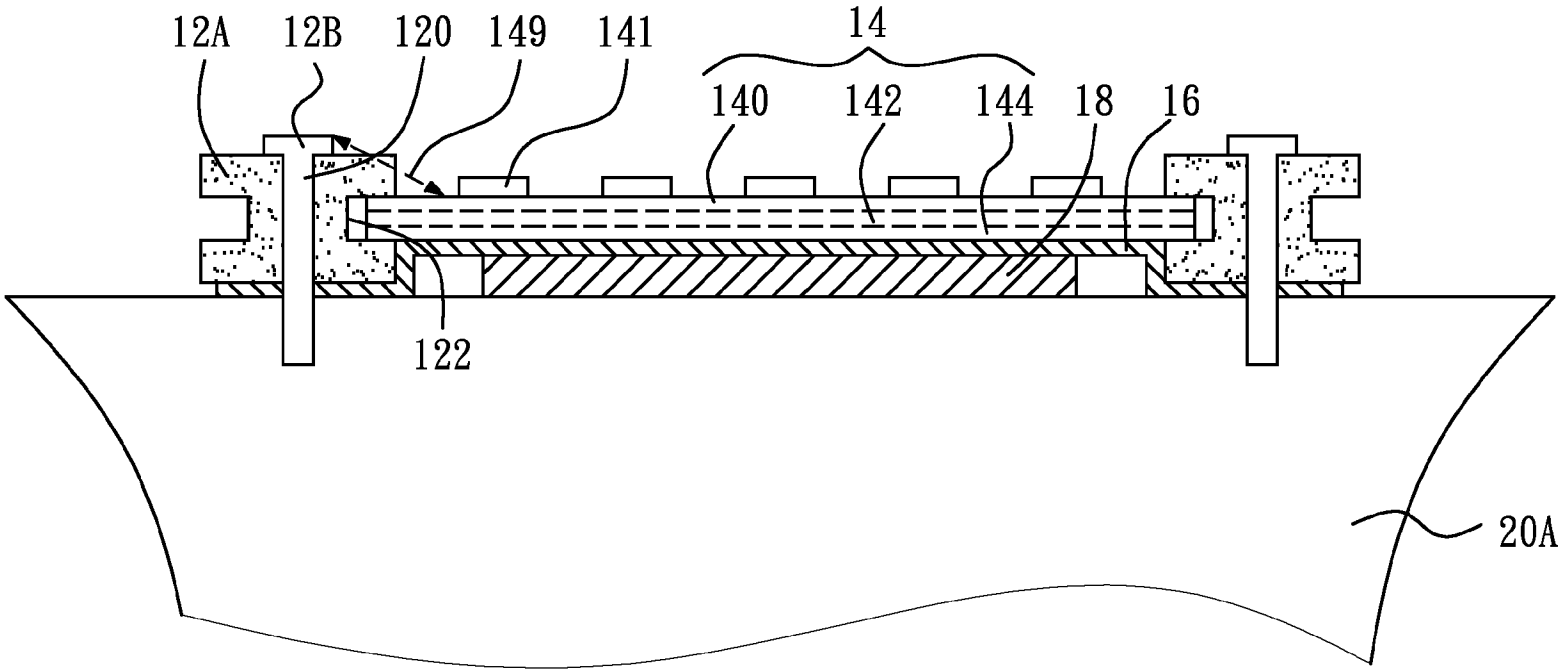
FIG. 2E shows a partial cross sectional view of another modified embodiment of the first embodiment.

According to the cross sectional structure of FIG. 2C, the electrical-insulation clamping member 12A of the embodiment is fixed on the bottom housing 20A via the screw 12B. The LED substrate 14 is clamped by the opposing electrical-insulation clamping members 12A. In another modified embodiment (FIG. 2D), both the LED substrate 14 and the heat-conduction insulation sheet 16 are clamped by the opposing electrical-insulation clamping members 12A. The LED substrate 14 may be made of, but not limited to, an aluminum substrate, a ceramic substrate, a copper substrate or other substrate that is made of good heat-conduction material. The LED substrate 14 may include, from top to bottom, a circuit wiring layer 140 and a heat-conduction layer 144, and at least one LED chip 141 is fixed on the circuit wiring layer 140. The LED chip 141 to be fixed may be in a module, a package or other forms suitable to be fixed on the LED substrate 14. For example, the LED chip 141 may be a surface-mounted device (SMD) package or a pin through hole (PTH) package. In another modified embodiment, a high-voltage insulation layer 142 is disposed between the circuit wiring layer 140 and the heat-conduction layer 144 as shown in FIG. 2E. According to the clamping described above, the insulating impedance between circuit wiring and the screw 12B may be increased without sacrificing layout space on the circuit wiring layer 140, thereby preventing improper electrical conduction and passing product security test. In other words, the embodiment may increase spatial distance 149 (that is, the minimum electrical-conduction distance between outmost wiring of the circuit wiring layer 140 and the neighboring screw 12B) in order to increase the insulating impedance between the circuit wiring and the screw 12B.

Figure 2F:
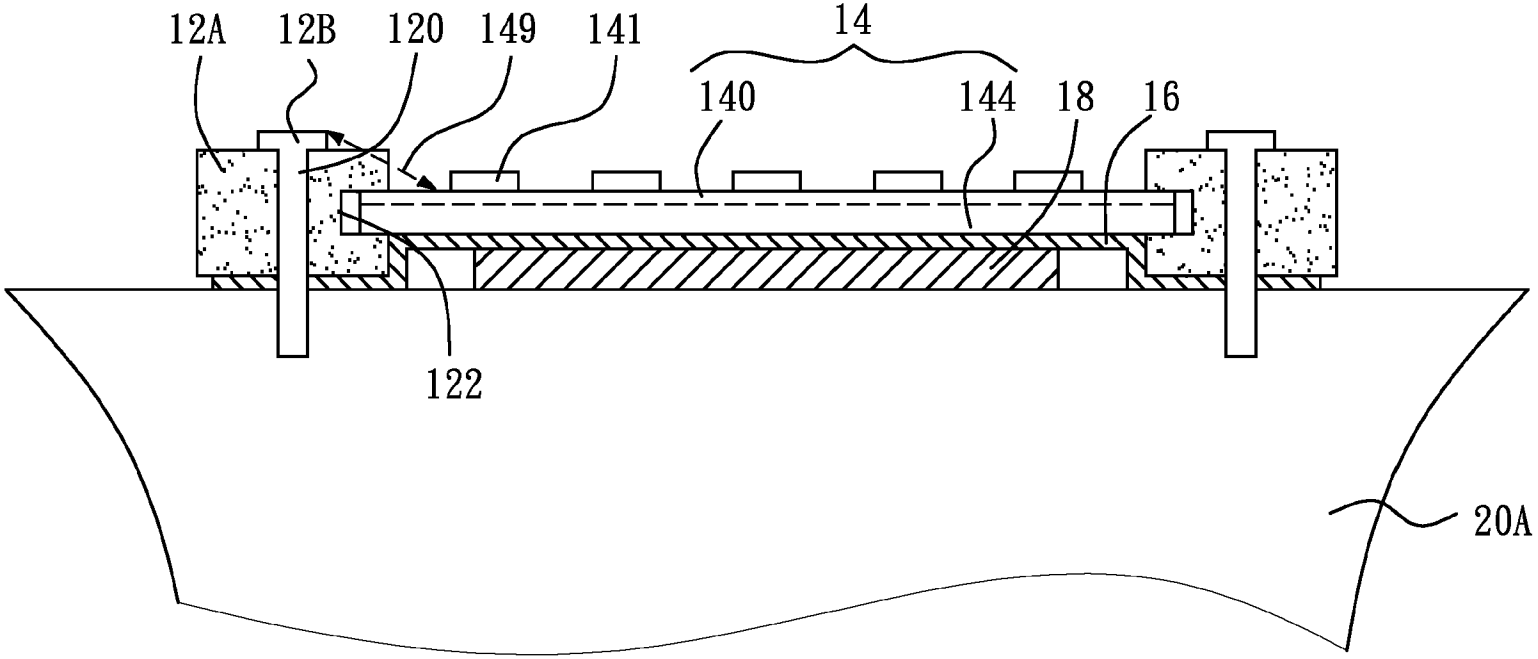
FIG. 2F shows a partial cross sectional view of a further modified embodiment of the first embodiment.

The heat-conduction pad 18 is disposed between the bottom surface of the heat-conduction insulation sheet 16 and the top surface of the bottom housing 20A, and is used to transfer the heat generated by the LED chip 141 to a sink 200 (FIG. 2A) of the bottom housing 20A. The heat-conduction pad 18 may be made of, but not limited to, aluminum material. In one embodiment, the heat-conduction pad 18 is integrated with the top surface of the bottom housing 20A. In another embodiment, the heat-conduction pad 18 is an independent component separable from the bottom housing 20A. According to a further modified embodiment, the recess 122 of the electrical-insulation clamping member 12A is locally located as shown in FIG. 2F.

According to the modified embodiments of the first embodiment, with respect to spatial location, the heat-conduction insulation sheet 16 is disposed between the LED substrate 14 and the heat-conduction pad 18. With respect to fixation, the heat-conduction insulation sheet 16 may be exerted by one or more forces. Regarding FIG. 2C, FIG. 2E or FIG. 2F, the heat-conduction insulation sheet 16 is exerted by top/bottom contact force from the LED substrate 14 and the heat-conduction pad 18 respectively. In addition, at least one end of the heat-conduction insulation sheet 16 is fastened between the electrical-insulation clamping member 12A and the bottom housing 20A by exertion force of the electrical-insulation clamping member 12A and the screw 12B. Regarding FIG. 2D, the heat-conduction insulation sheet 16 is exerted by top/bottom contact force from the LED substrate 14 and the heat-conduction pad 18 respectively. In addition, the heat-conduction insulation sheet 16 is exerted by lateral clamping force of the electrical-insulation clamping member 12A. It is appreciated that the heat-conduction sheet 16 may be fixed in a way other than those described in the modified embodiments. For example, the heat-conduction insulation sheet 16 may be exerted merely by top/bottom contact force from the LED substrate 14 and the heat-conduction pad 18 respectively (that is, the heat-conduction insulation sheet 16 is not exerted by the electrical-insulation clamping member 12A and/or the screw 12B); or the heat-conduction insulation sheet 16 may be fixed independently (or with other fixation) by fastener.

Figure 3A:
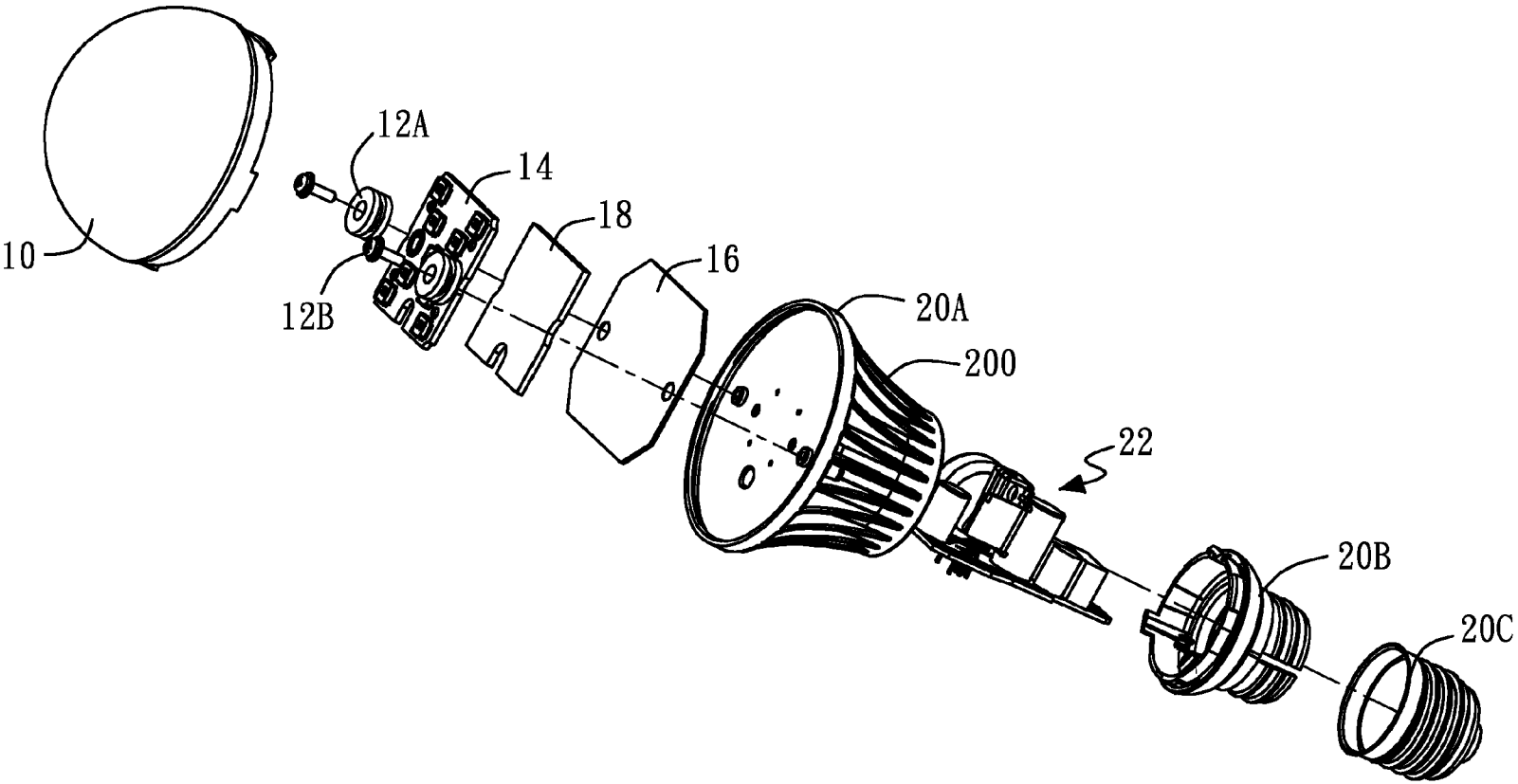
FIG. 3A shows an exploded view of an LED illumination apparatus according to a second embodiment of the present invention.
Figure 3B:
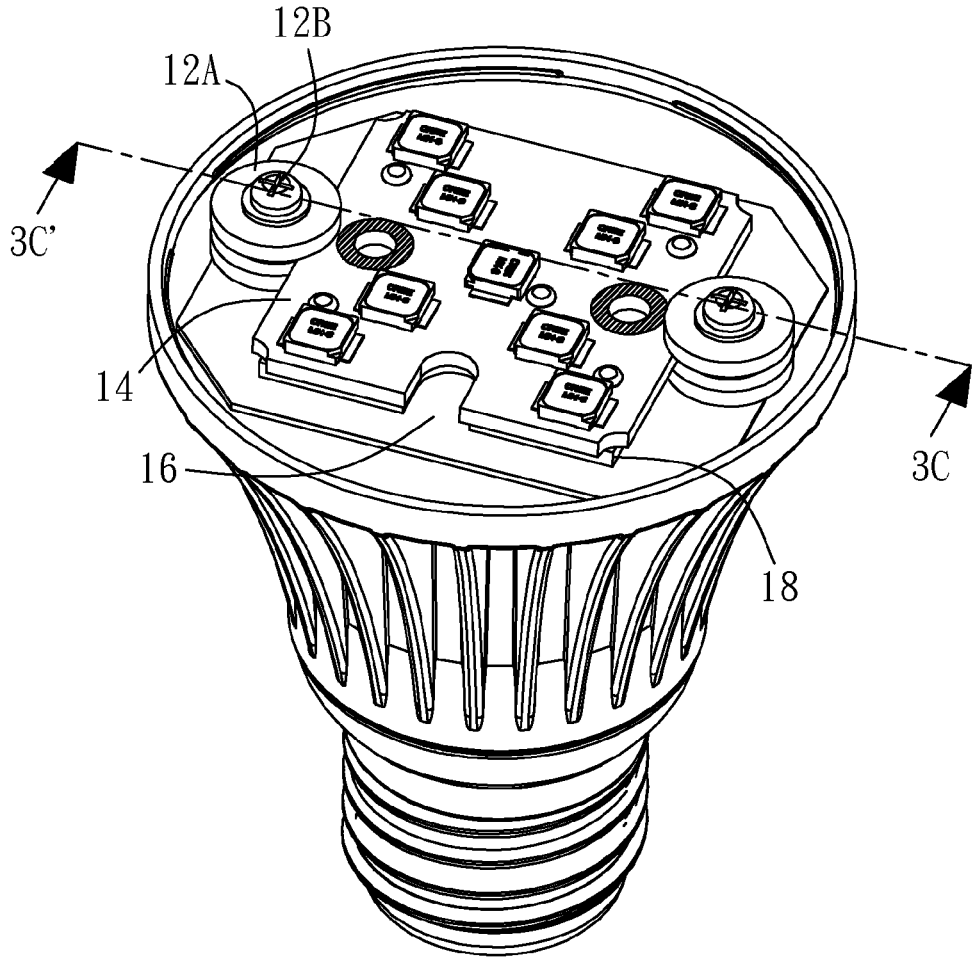
FIG. 3B shows a perspective view of an assembled LED illumination apparatus except for the lamp cover.
Figure 3C:
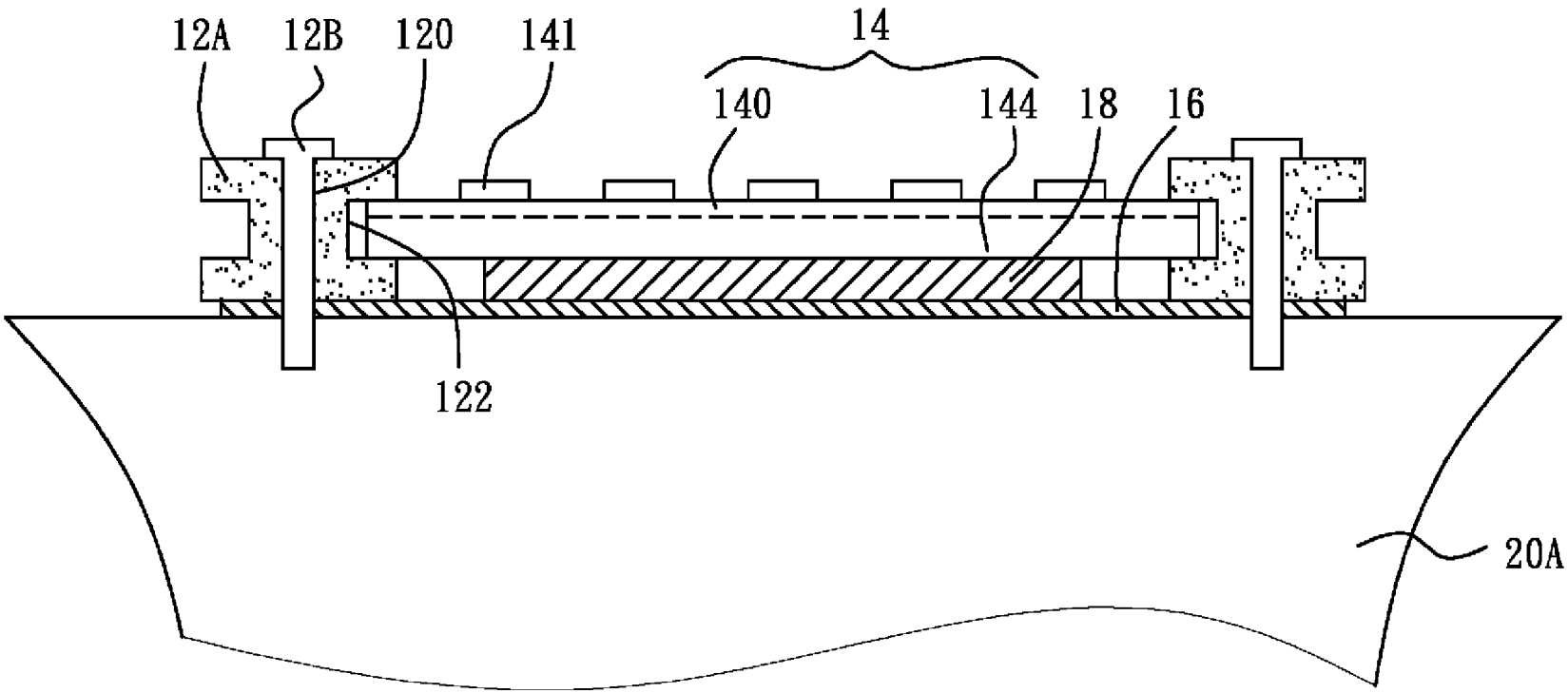
FIG. 3C shows a partial cross sectional view along a section line 3C-3C' of FIG. 3B.

FIG. 3A shows an exploded view of an LED illumination apparatus according to a second embodiment of the present invention. FIG. 3B shows a perspective view of an assembled LED illumination apparatus except for the lamp cover. FIG. 3C shows a partial cross sectional view along a section line 3C-3C' of FIG. 3B. As the present embodiment is similar to the previous embodiment, same elements thus use same reference numerals, and description of their associated composition or material is omitted for brevity. The main difference between the present embodiment and the previous embodiment is that, the heat-conduction insulation sheet 16 of the present embodiment is disposed between the bottom housing 20A and the heat-conduction pad 18, while the heat-conduction insulation sheet 16 of the previous embodiment is disposed between the heat-conduction pad 18 and the LED substrate 14. In other words, the heat-conduction insulation sheet 16 and the heat-conduction pad 18 are interchanged between the first embodiment and the second embodiment. According to a modified embedment of the second embodiment, an additional heat-conduction insulation sheet 16B (FIG. 3D) is disposed between the heat-conduction pad 18 and the LED substrate 14, and both the LED substrate 14 and the additional heat-conduction insulation sheet 16B are clamped by the electrical-insulation clamping member 12A.

Figure 3D:
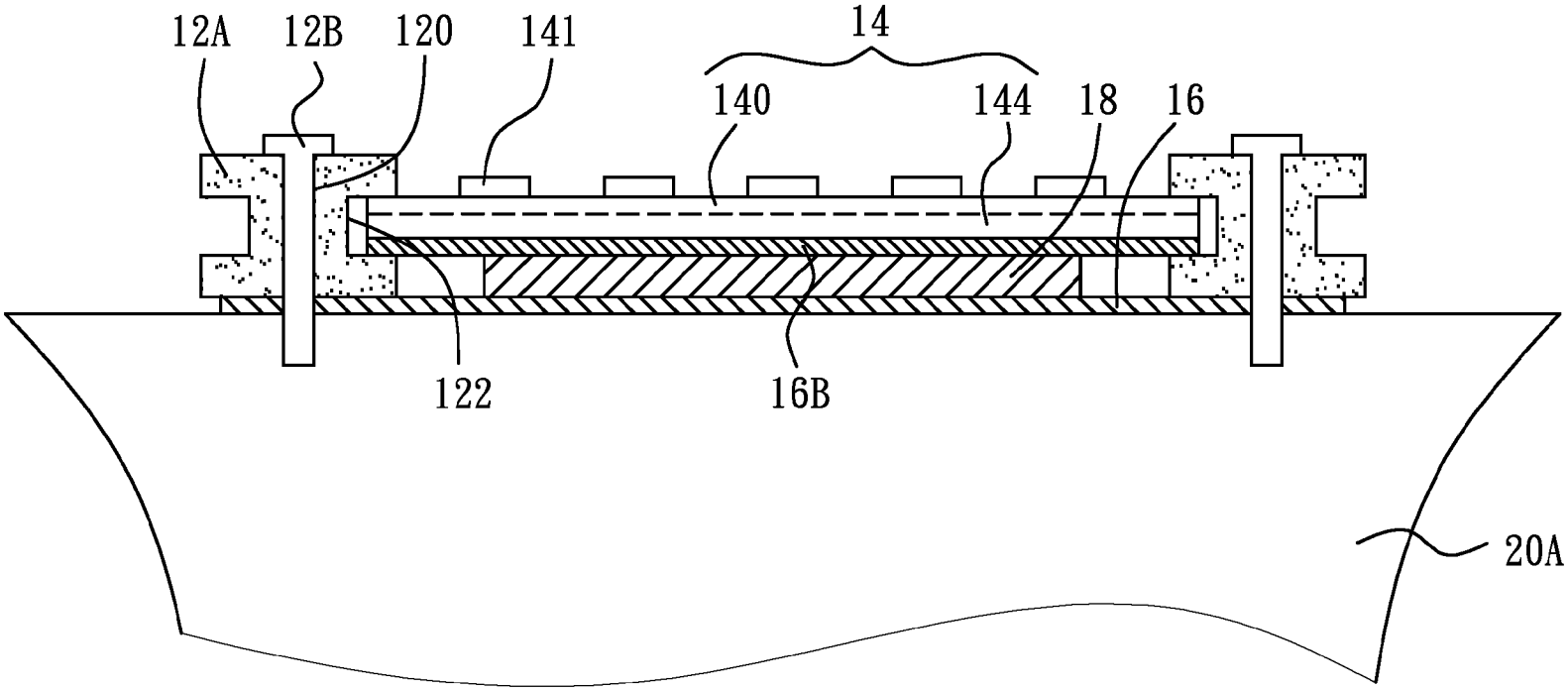
FIG. 3D shows a partial cross sectional view of a modified embodiment of the second embodiment.
Figure 3E:
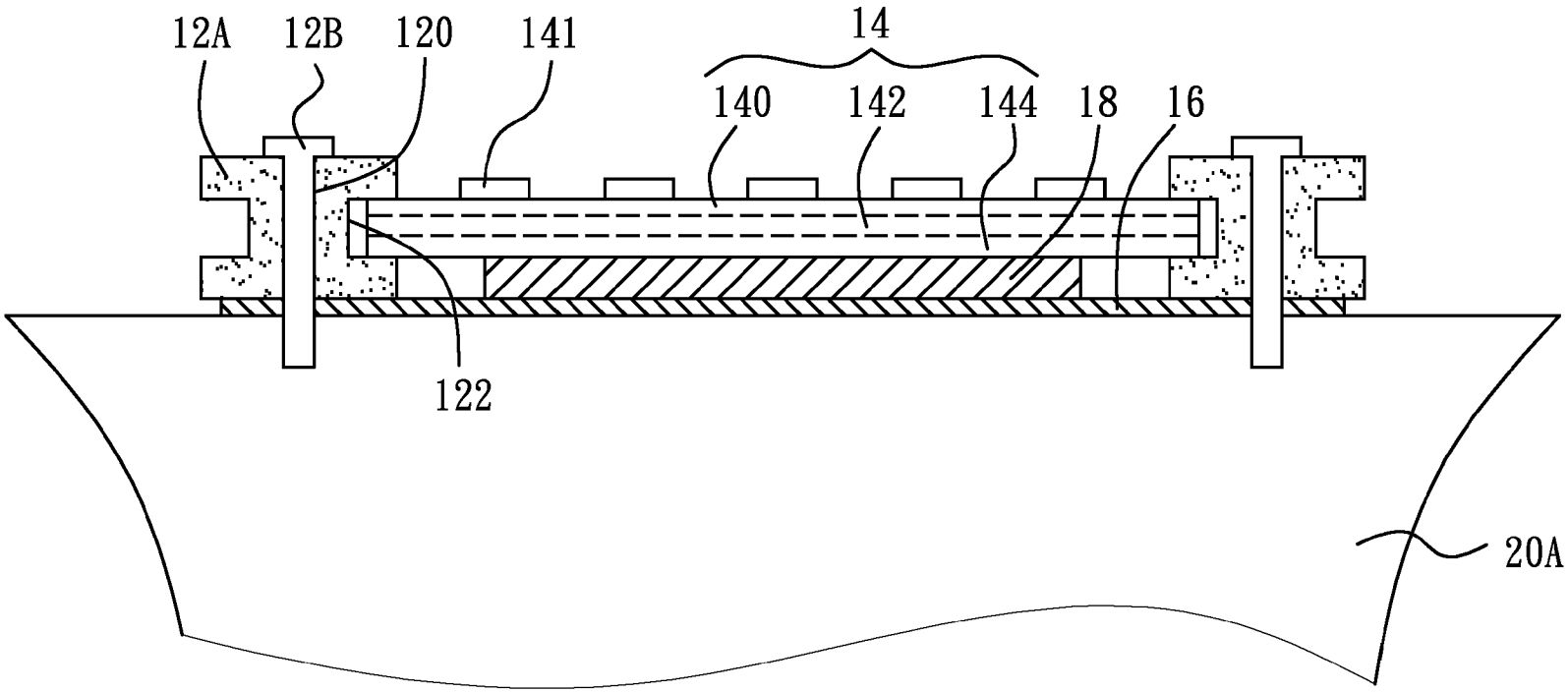
FIG. 3E shows a partial cross sectional view of another modified embodiment of the second embodiment.
Figure 3F:
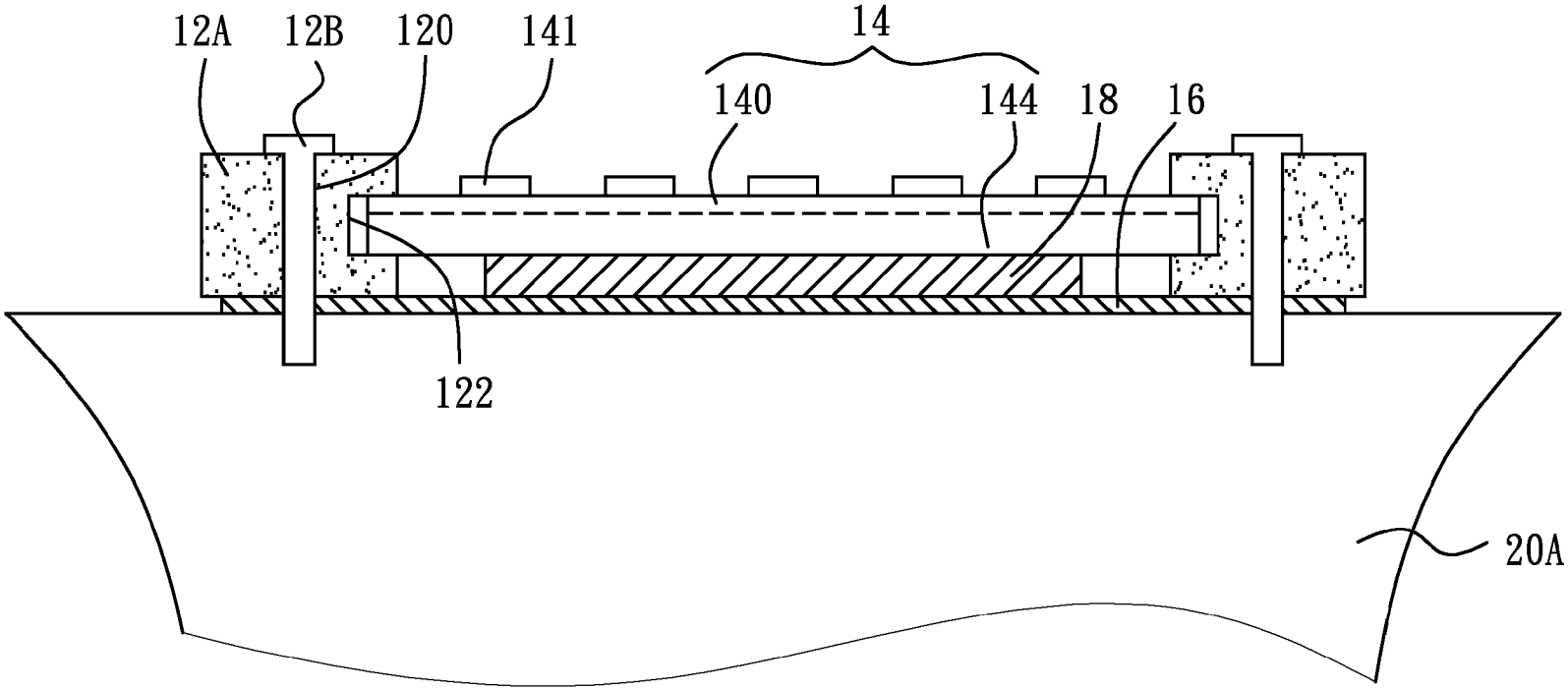
FIG. 3F shows a partial cross sectional view of a further modified embodiment of the second embodiment.

In another modified embodiment, a high-voltage insulation layer 142 is disposed between the circuit wiring layer 140 and the heat-conduction layer 144 as shown in FIG. 3E. According to a further modified embodiment, the recess 122 of the electrical-insulation clamping member 12A is locally located as shown in FIG. 3F.

According to the modified embodiments of the second embodiment, with respect to spatial location, the heat-conduction insulation sheet 16 is disposed between the heat-conduction pad 18 and the bottom housing 20A, and the additional heat-conduction insulation sheet 16B is disposed between the LED substrate 14 and the heat-conduction pad 18. With respect to fixation, the heat-conduction insulation sheet 16 or the additional heat-conduction insulation sheet 16B may be exerted by one or more forces. Regarding FIG. 3C, FIG. 3D, FIG. 3E or FIG. 3F, the heat-conduction insulation sheet 16 is exerted by top/bottom contact force from the heat-conduction pad 18 and the bottom housing 20A respectively. In addition, at least one end of the heat-conduction insulation sheet 16 is fastened between the electrical-insulation clamping member 12A and the bottom housing 20A by exertion force of the electrical-insulation clamping member 12A and the screw 12B. It is appreciated that the heat-conduction sheet 16 may be fixed in a way other than those described in the modified embodiments. For example, the heat-conduction insulation sheet 16 may be exerted merely by top/bottom contact force from the heat-conduction pad 18 and the bottom housing 20A respectively (that is, the heat-conduction insulation sheet 16 is not exerted by the electrical-insulation clamping member 12A and/or the screw 12B); or the heat-conduction insulation sheet 16 may be fixed independently (or with other fixation) by fastener.

With respect to the additional heat-conduction insulation sheet 16B, as exemplified in FIG. 3D, the additional heat-conduction insulation sheet 16B is exerted by top/bottom contact force from the LED substrate 14 and the heat-conduction pad 18 respectively. In addition, the additional heat-conduction insulation sheet 16B is exerted by lateral clamping force of the electrical-insulation clamping member 12A. It is appreciated that the additional heat-conduction sheet 16B may be fixed in a way other than those described in the modified embodiments. For example, the additional heat-conduction insulation sheet 16B may be exerted merely by top/bottom contact force from the LED substrate 14 and the heat-conduction pad 18 respectively (that is, the additional heat-conduction insulation sheet 16B is not exerted by the electrical-insulation clamping member 12A); or the additional heat-conduction insulation sheet 16B may be fixed independently (or with other fixation) by fastener; or at least one end of the additional heat-conduction insulation sheet 16B is fastened between the electrical-insulation clamping member 12A and the bottom housing 20A by exertion force of the electrical-insulation clamping member 12A and the screw 12B.

Although specific embodiments have been illustrated and described, it will be appreciated by those skilled in the art that various modifications may be made without departing from the scope of the present invention, which is intended to be limited solely by the appended claims.

What is claimed is:

1. A light-emitting diode (LED) illumination apparatus, comprising:

a housing;

an LED substrate with at least one LED chip fixed thereon;

at least two electrical-insulation clamping members and associated screws, each said electrical-insulation clamping member having a threaded hole for screwing the screw to fasten the electrical-insulation clamping to the housing, wherein each said electrical-insulation clamping member is formed integrally and has a recess for clamping a periphery of the LED substrate and the recess of the electrical-insulation clamping member has a direction perpendicular to a direction of the threaded hole; and a heat-conduction pad disposed between the housing and the LED substrate and used to conduct heat generated by the LED chip.

2. The apparatus of claim 1, further comprising a heat-conduction insulation sheet disposed between the LED substrate and the heat-conduction pad.

3. The apparatus of claim 2, wherein the heat-conduction insulation sheet is clamped by the electrical-insulation clamping members.

4. The apparatus of claim 2, wherein at least one end of the heat-conduction insulation sheet is fastened between the electrical-insulation clamping member and the housing by exertion force of the electrical-insulation clamping member and the screw.

5. The apparatus of claim 1, further comprising a heat-conduction insulation sheet disposed between the heat-conduction pad and the housing.

6. The apparatus of claim 5, at least one end of the heat-conduction insulation sheet is fastened between the electrical-insulation clamping member and the housing by exertion force of the electrical-insulation clamping member and the screw.

7. The apparatus of claim 5, further comprising an additional heat-conduction insulation sheet disposed between the LED substrate and the heat-conduction pad.

8. The apparatus of claim 7, wherein the additional heat-conduction insulation sheet is clamped by the electrical-insulation clamping members.

9. The apparatus of claim 1, wherein the electrical-insulation clamping member is made of plastic material.

10. The apparatus of claim 1, wherein the electrical-insulation clamping member is double-layer cylinders in shape.

11. The apparatus of claim 1, wherein the heat-conduction pad is integrated with the housing.

12. The apparatus of claim 1, wherein the heat-conduction pad is made of aluminum material.

13. The apparatus of claim 1, wherein the LED substrate is an aluminum substrate, a ceramic substrate or a copper substrate.

14. The apparatus of claim 1, wherein the LED substrate comprises a circuit wiring layer and a heat-conduction layer, wherein the LED chip is fixed on the circuit wiring layer.

15. The apparatus of claim 14, wherein the LED chip to be fixed is in a module or a package.

16. The apparatus of claim 15, wherein the package of the LED chip is a surface-mounted device (SMD) package or a pin through hole (PTH) package.

17. The apparatus of claim 14, further comprising a high-voltage insulation layer disposed between the circuit wiring layer and the heat-conduction layer.

18. The apparatus of claim 1, wherein the housing comprises a bottom housing, a top housing and an electrode contact part in order, wherein the electrical-insulation clamping member is fixed on the bottom housing.

19. The apparatus of claim 18, further comprising a power supply disposed in a space defined by the bottom housing and the top housing.

20. The apparatus of claim 1, further comprising a lamp cover to cover the LED substrate, the electrical-insulation clamping member, the screw and the heat-conduction pad.

* * * * *